US007989719B2

(12) United States Patent
Sun

(10) Patent No.: US 7,989,719 B2
(45) Date of Patent: Aug. 2, 2011

(54) UNIVERSAL SERIAL BUS INTERFACE AND PANEL WITH THE SAME

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 193 days.

(21) Appl. No.: 12/507,810

(22) Filed: Jul. 23, 2009

(65) Prior Publication Data

US 2010/0307894 A1 Dec. 9, 2010

(30) Foreign Application Priority Data

Jun. 8, 2009 (CN) ..... 2009 1 0303041

(51) Int. Cl.
*H01H 17/02* (2006.01)

(52) U.S. Cl. ..... 200/51 R; 200/51.11

(58) Field of Classification Search ..... 200/51 R, 200/51.11, 51.12
See application file for complete search history.

(56) References Cited

U.S. PATENT DOCUMENTS

| | | | | |
|---|---|---|---|---|
| 6,162,078 | A * | 12/2000 | Chung | 439/188 |
| 6,281,457 | B1 * | 8/2001 | Chang | 200/547 |
| 6,608,264 | B1 * | 8/2003 | Fouladpour | 200/51.03 |
| 7,607,926 | B2 * | 10/2009 | Wang | 439/188 |
| 7,895,384 | B2 * | 2/2011 | Matsui | 710/300 |
| 2010/0044195 | A1 * | 2/2010 | Chiang et al. | 200/175 |
| 2010/0142544 | A1 * | 6/2010 | Chapel et al. | 370/401 |

* cited by examiner

*Primary Examiner* — Gary F. Paumen
(74) *Attorney, Agent, or Firm* — Zhigang Ma

(57) ABSTRACT

A universal serial bus (USB) interface is used to connect to a USB device. When the driving pole of the USB interface is pressed, the conductive washer of the USB interface is driven to move away from the first terminal and the second terminal of the positive differential signal pin of the USB interface, an electrical connection between the first and second terminals of the positive differential signal pin is cut. When the driving pole is loosed, the conductive washer returns back, to contact the first terminal and the second terminal of the positive differential signal pin, the first and second terminals of the positive differential signal pin are thus electrically connected.

12 Claims, 4 Drawing Sheets

UNIVERSAL SERIAL BUS INTERFACE AND PANEL WITH THE SAME

BACKGROUND

1. Technical Field

The present disclosure relates to a universal serial bus (USB) interface and a panel with the same.

2. Description of Related Art

With advances in computer technology, peripheral devices using USB connectors have become more and more popular. When a USB device is not in use, the USB device can be unplugged from the computer, and plugged back in when needed. However, repeated plugging or unplugging of the USB device is unduly laborious and time-consuming, and may eventually damage the USB interface.

DETAILED DESCRIPTION

Figure 1:
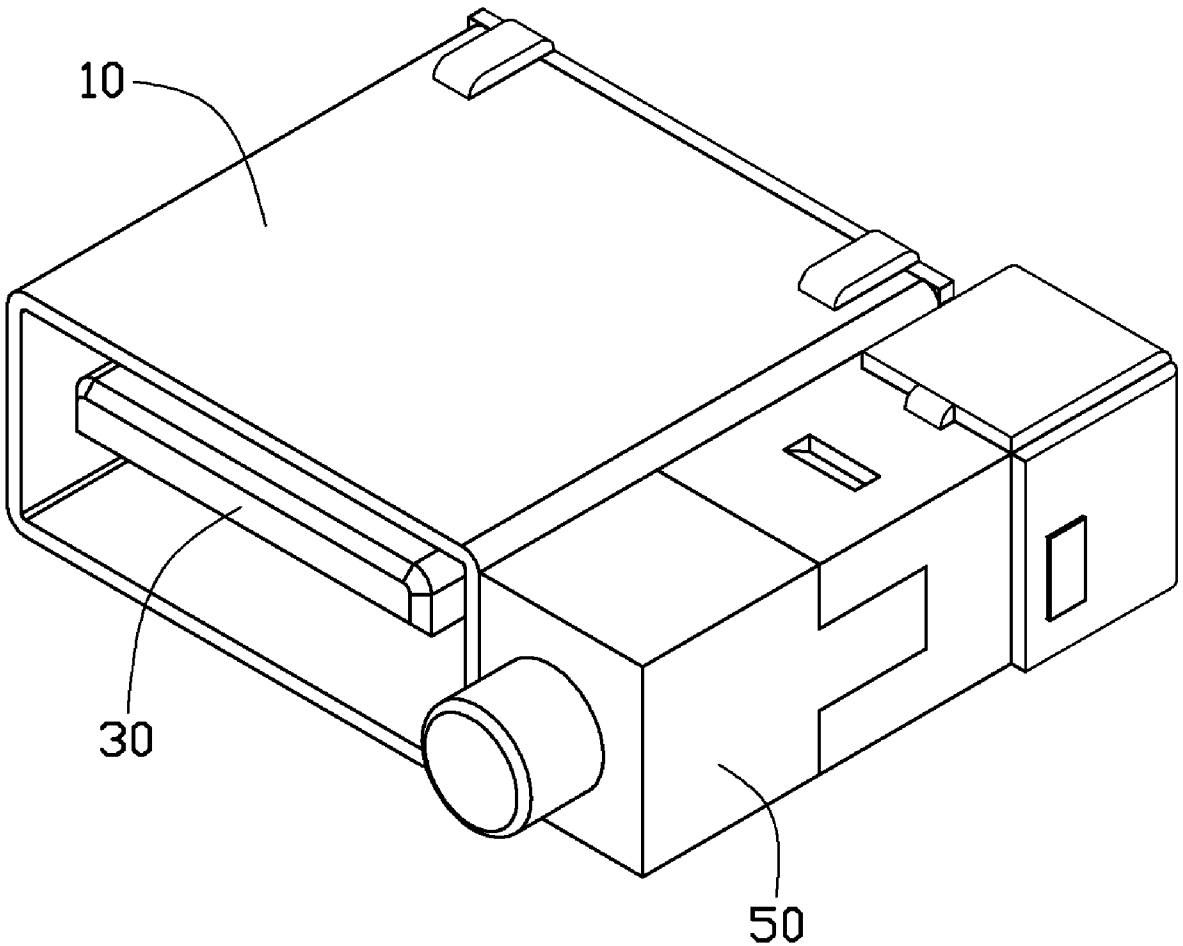
FIG. 1 is an assembled, isometric view of an exemplary embodiment of a universal serial bus (USB) interface.

Referring to FIG. 1, an exemplary embodiment of a universal serial bus (USB) interface includes a frame 10, a USB body 30, and a switch 50.

Figure 2:
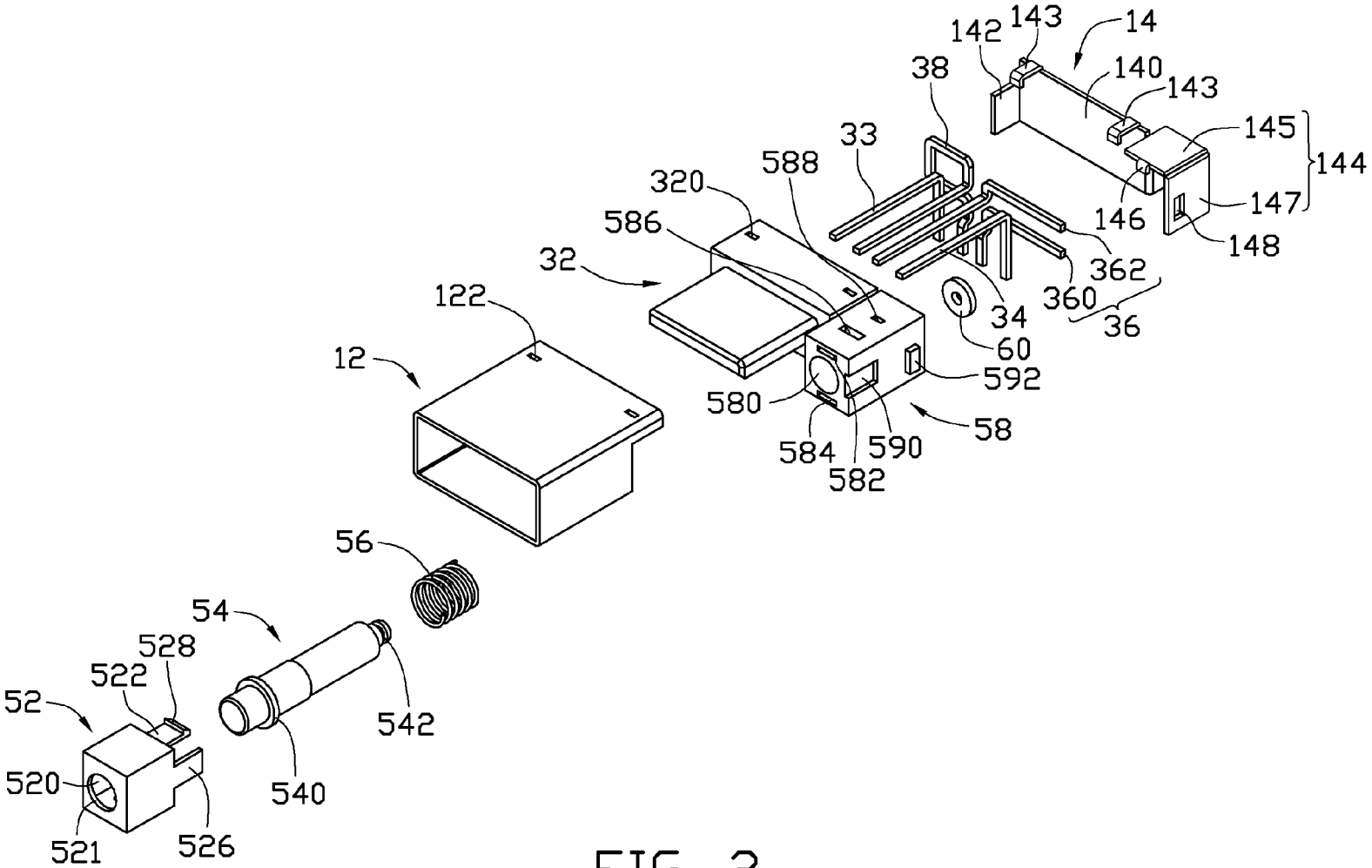
FIG. 2 is an exploded, isometric view of the USB interface of FIG. 1.
Figure 3:
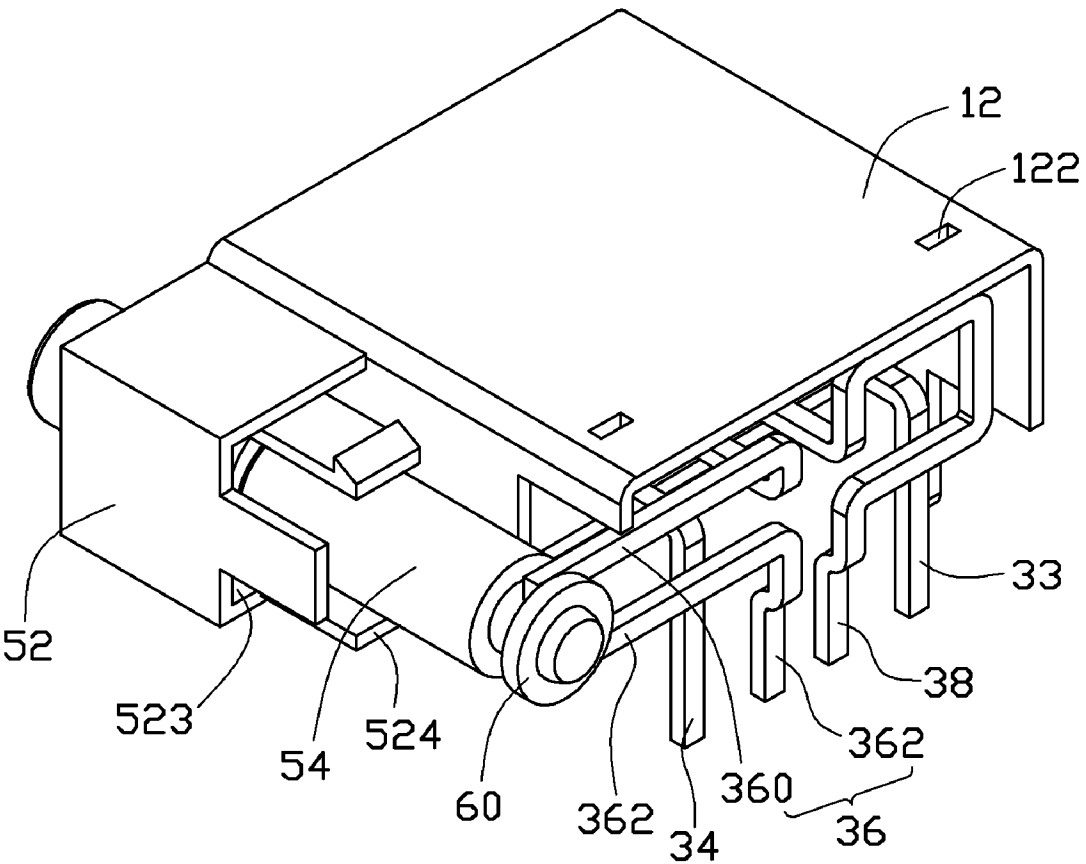
FIG. 3 is a partly assembled view of the USB interface of FIG. 2.

Referring to FIGS. 2 and 3, the frame 10 includes a box-shaped accommodating body 12 defining two openings in opposite sides, and a cover 14. The accommodating body 12 is used to receive the USB body 30. A pair of fixing holes 122 is defined in a top of the accommodating body 12. The cover 14 includes a rectangle-shaped base 140. A side plate 142 perpendicularly extends from a first end of the base 140. An accommodating portion 144 perpendicularly extends from a second end opposite to the first end of the base 140. A pair of L-shaped hooks 143 extends from a top of the base 140. The accommodating portion 144 is substantially L-shaped, and includes a horizontal top wall 145 and a vertical side wall 147 perpendicularly extending down from a first side opposite to the side plate 142 of the top wall 145. A clasp 146 extends from a second side opposite to the base 140 of the top wall 145. A positioning hole 148 is defined in the side wall 147.

The USB body 30 includes a USB holding portion 32, an L-shaped voltage signal pin 33, an L-shaped ground pin 34, a positive differential signal pin 36, and a negative differential signal pin 38. The voltage signal pin 33, the ground pin 34, the positive differential signal pin 36, and the negative differential signal pin 38 can be assembled in the USB holding portion 32. A pair of fixing slots 320 is defined in a top of the USB holding portion 32. The positive differential signal pin 36 includes a first terminal 360 and a second terminal 362. The first terminal 360 and the second terminal 362 space a distance. In one embodiment, the first terminal 360 and the second terminal 362 are L-shaped, and are made of conductive material.

The switch 50 includes a cuboid-shaped receiving portion 52, a driving pole 54, an elastic member such as a helical spring 56, a holding portion 58, and a conductive washer 60. A receiving space 520 is defined in the receiving portion 52. A round opening 521 and a square opening 523 are respectively defined in opposite end surfaces of the receiving portion 52, communicating with the receiving space 520. A first connecting piece 522, a second connecting piece 524, and a third connecting piece 526 are respectively extended from a top, a bottom, and a side of the end surface defining the square opening 523 of the receiving portion 52, perpendicular to the end surface. The first connecting piece 522 is parallel to the second connecting piece 524. A clip 528 protrudes from a distal end of the first connecting piece 522.

The driving pole 54 is column-shaped and made of insulated material. A circular-shaped protrusion 540 protrudes from a circumference of the driving pole 54, adjacent to a first end of the driving pole 54. A fixing portion 542 extends from a second end opposite to the first end of the driving pole 54. A diameter of the protrusion 540 is smaller than a size of the opening 523, while greater than a diameter of the opening 521. The switch holding portion 58 is juxtaposed with the USB holding portion 32. A round through hole 580 is defined in the switch holding portion 58, through a first end surface and a second end surface opposite to the first end surface of the switch holding portion 58, to receive the driving pole 54. A first connecting slot 582 and a second connecting slot 584 are respectively defined in the first end surface of the switch holding portion 58, at opposite sides of the through hole 580. A locking hole 586 and a latching slot 588 are defined in a top of the switch holding portion 58, the locking hole 586 communicating with the first connecting slot 582. A sidewall of the switch holding portion 58 away from the USB holding portion 32 defines a receiving slot 590 through the first end surface of the switch holding portion 58. A positioning portion 592 extends from the sidewall of the switch holding portion 58, opposite to the receiving slot 590.

Referring to FIGS. 1 and 3, in assembly, the second end of the driving pole 54 fits about the spring 56, a first end of the spring 56 resisting against the protrusion 540. The driving pole 54 together with the spring 56 are inserted into the through hole 580 of the switch holding portion 58, a second end opposite to the first end of the spring 56 resisting against an inner side of the second end surface of the switch holding portion 58. The fixing portion 542 of the driving pole 54 extends out of the second end surface of the switch holding portion 58. Distal ends of the first terminal 360 and the second terminal 362 of the positive differential signal pin 36 are respectively in contact with opposite sides of the fixing portion 542. The washer 60 is fixed to the fixing portion 542 and contacts the first terminal 360 and the second terminal 362 of the positive differential signal pin 36. Therefore, the first and second terminals 360 are sandwiched between the washer 60 and the second end surface of the switch holding portion 58.

The first end of the driving pole 54 passes through the opening 523, the receiving space 520, and the opening 521 of the receiving portion 52. The protrusion 540 resists against an inner side of the first end surface of the receiving portion 52. The first connecting piece 522 of the receiving portion 52 is inserted into the first connecting slot 582 of the switch holding portion 58, with the clip 528 being engaged in the locking hole 586 of the switch holding portion 58. The second connecting piece 524 and the third connecting piece 526 are respectively inserted into the second connecting slot 584 and the receiving slot 590.

The accommodating body 12 receives the USB holding portion 32, the voltage signal pin 33, the ground pin 34, the negative differential signal pin 38, and the positive differential signal pin 36, the switch holding portion 58 is located outside of the accommodating body 12. The fixing holes 122 of the accommodating body 12 align with the corresponding fixing slots 320 of the USB holding portion 32. The cover 14 is attached to the USB holding portion 32 and the switch holding portion 58, to cover the voltage signal pin 33, the ground pin 34, and the positive and negative differential signal pins 36 and 38. The hooks 143 of the cover 14 pass through the corresponding fixing holes 122 of the accommodating body 12 to be locked in the corresponding fixing slots 320 of the USB holding portion 32. The accommodating portion 144 covers on the second end surface of the switch holding portion 58. The clasp 146 of the accommodating portion 144 is locked in the latching slot 588 of the switch holding portion 58. The positioning portion 592 of the switch holding portion 58 is locked in the positioning hole 148 of the accommodating portion 144. The side plate 142 firmly resists against a sidewall opposite to the switch holding portion 58 of the accommodating body 12.

The first terminal 360 and the second terminal 362 of the positive differential signal pin 36 are connected together via the washer 60. Therefore, the transfer paths of the positive differential signal pin 36 and the negative differential signal pin 38 are the same.

In use, when the driving pole 54 is pressed, the spring 56 is compressed, and the washer 60 is driven to move away from the first terminal 360 and the second terminal 362 of the positive differential signal pin 36. Therefore, electrical connection of the positive differential signal pin 36 is cut. When the driving pole 54 is loosed, the spring 56 restores to drive the washer 60 to return back, to contact the first terminal 360 and the second terminal 362 of the positive differential signal pin 36. Therefore, the positive differential signal pin 36 is electrically connected. The theory is the same as a USB device being unplugged from a computer and plugged to the computer again. Therefore, the USB interface in one embodiment can be used conveniently without having to plug and unplug for each use.

Figure 4:
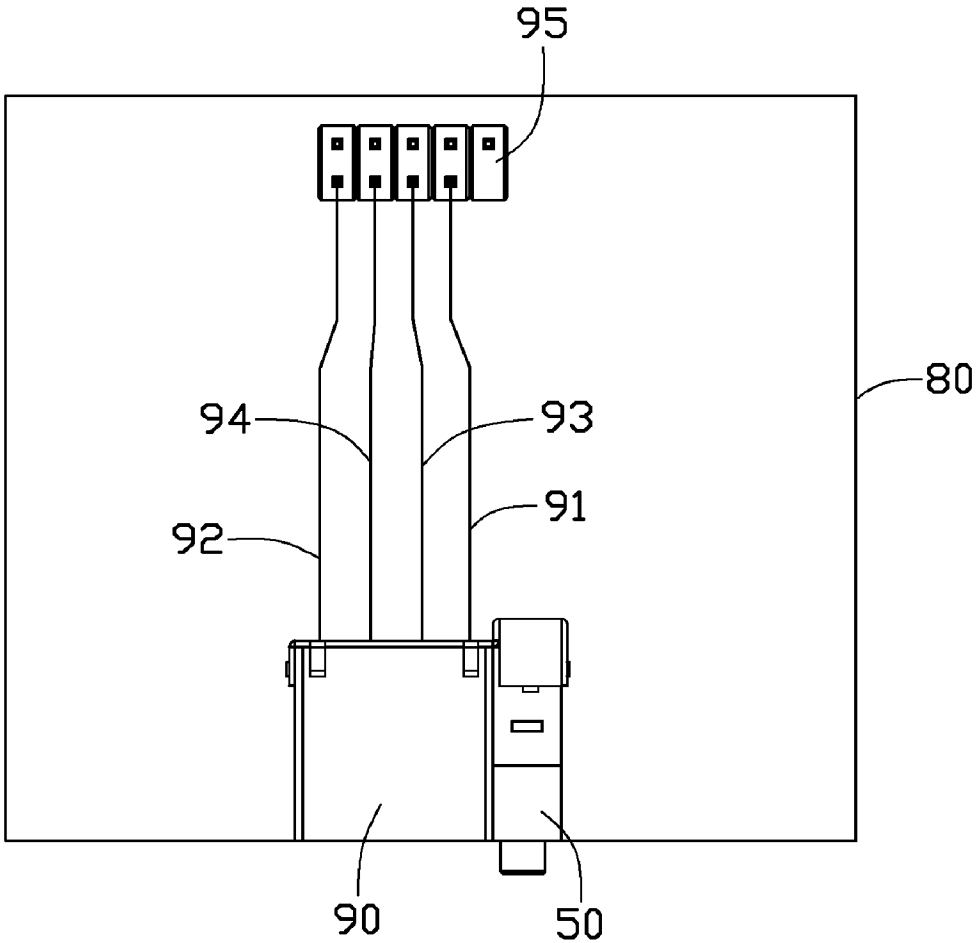
FIG. 4 is a schematic diagram of a panel with the USB interface of FIG. 1.

Referring to FIG. 4, an exemplary embodiment of a panel 80 with the above-mentioned USB interface includes a voltage signal line 91 connected to the voltage signal pin 33 of the USB interface, a ground line 92 connected to the ground pin 34 of the USB interface, a positive differential signal line 93 connected to the positive differential signal pin 36 of the USB interface, a negative differential signal line 94 connected to the negative differential signal pin 38 of the USB interface, and a USB connector 95 connected to a motherboard (not shown) of a computer. The voltage signal line 91, the ground line 92, the positive differential signal line 93, and the negative differential signal line 94 are also connected to the USB connector 95 according to known technology.

A USB device can be mounted to the panel 80 to communicate with the motherboard of the computer via the USB interface. If the USB device is disconnected from the motherboard of the computer via software while the USB device is still plugged to the USB interface, the driving pole 54 of the switch 50 only needs to be pressed once and then released to make the washer 60 contact the positive differential signal pin 36, in response to the USB device needing to communicate with the motherboard again. The USB device can be identified by the motherboard of the computer again. Therefore, the panel 80 with the USB interface can be used to avoid frequently plugging and unplugging the USB device to and from the computer, thereby protecting the USB interface.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching. The embodiments were chosen and described in order to explain the principles of the disclosure and their practical application so as to enable others skilled in the art to utilize the disclosure and various embodiments and with various modifications as are suited to the particular use contemplated. Alternately embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A universal serial bus (USB) interface comprising:

a USB body comprising:

a USB holding portion;

a positive differential signal pin mounted to the USB holding portion, the positive differential signal pin comprising:

a first terminal made of conductive material; and a second terminal made of conductive material, the second terminal spaced a distance to the first terminal; and a negative differential signal pin mounted to the USB holding portion; and a switch located adjacent to the USB body, comprising:

a driving pole made of insulation material; and a conductive washer fixed to the driving pole, to contact with or depart from the first terminal and the second terminal of the positive differential signal pin;

wherein when the driving pole is pressed, the conductive washer is driven to depart from the first terminal and the second terminal of the positive differential signal pin, an electrical connection between the first terminal and the second terminal of the positive differential signal pin is cut; when the driving pole is loosed, the conductive washer returns back, to contact the first terminal and the second terminal of the positive differential signal pin, and the first terminal and the second terminal of the positive differential signal pin are thus electrically connected.

2. The USB interface of claim 1, wherein the USB body further comprises a voltage signal pin and a ground pin mounted to the USB holding portion.

3. The USB interface of claim 1, wherein the switch further comprises a receiving portion, a switch holding portion, and an elastic member, a circular-shaped protrusion protrudes from a circumference of the driving pole, adjacent to a first end of the driving pole, a second end opposite to the first end of the driving pole fits about the elastic member, a first end of the elastic member resisting against the protrusion, the driving pole together with the elastic member are inserted into the switch holding portion, a second end opposite to the first end of the elastic member resists against an inner side of the switch holding portion.

4. The USB interface of claim 3, wherein the receiving portion defines a receiving space, and two openings respectively define in opposite end surfaces of the receiving portion and communicating with the receiving space, to receive the driving pole, a plurality of connecting pieces extend from the receiving portion at one of the two openings, a through hole is defined in a first end surface of the switch holding portion to receive the driving pole, a plurality of connecting slots are defined in the first end surface of the switch holding portion, at opposite sides of the through hole, to receive the plurality of connecting pieces of the receiving portion.

5. The USB interface of claim 3, wherein a fixing portion extends from the second end of the driving pole, distal ends of the first terminal and the second terminal of the positive differential signal pin are operable to respectively contact opposite sides of the fixing portion, the washer is fixed to the fixing portion.

6. The USB interface of claim 4, wherein a clip protrudes from a distal end of one of the plurality of connecting pieces, a locking hole is defined in the switch holding portion, to engage with the clip of the connecting piece.

7. The USB interface of claim 1, further comprising a frame, wherein the frame comprises an accommodation body to receive the USB body, and a cover attached to the accommodation body to cover the positive and negative differential signal pins, and the switch holding portion.

8. The USB interface of claim 7, wherein the accommodation body is box-shaped and defines two openings in opposite sides, a plurality of fixing holes are defined in the accommodation body, a plurality of fixing slots are defined in the USB holding portion, corresponding to the plurality of fixing holes, the cover comprises a base covering the negative differential signal pin, a plurality of hooks extend from the base, and pass through the plurality of fixing holes to be locked in the plurality of fixing slots.

9. The USB interface of claim 7, wherein a side plate perpendicularly extends from a first end of the base to abut against the frame, an accommodating portion perpendicularly extends from a second end opposite to the first end of the base, to cover the switch holding portion.

10. The USB interface of claim 9, wherein a latching slot is defined in a top of the switch holding portion, a positioning portion protrudes from a side wall of the switch holding portion, the accommodating portion comprises a horizontal top wall and a vertical side wall perpendicularly extending down from a first side opposite to the side plate of the top wall, a clasp extends from a second side opposite to the base of the top wall, to be locked in the latching slot, a positioning hole is defined in the side wall, to engage with the positioning portion.

11. A panel comprising a universal serial bus (USB) interface, wherein the USB interface comprises:

a USB body comprising:

a USB holding portion;

a positive differential signal pin mount to the USB holding portion, comprising:

a first terminal made of conductive material; and a second terminal made of conductive material, and spaced from the first terminal; and a negative differential signal pin made of conductive material and mounted to the USB holding portion; and a switch comprising:

a driving pole made of insulation material; and a conductive washer fixed to the driving pole, to contact or depart from the first terminal and the second terminal of the positive differential signal pin;

wherein when the driving pole is pressed, the conductive washer is driven to move away from the first terminal and the second terminal of the positive differential signal pin, an electrical connection between the first terminal and the second terminal of the positive differential signal pin is cut; when the driving pole is loosed, the conductive washer returns back, to contact the first terminal and the second terminal of the positive differential signal pin, the first terminal and the second terminal of the positive differential signal pin are thus electrically connected.

12. The panel of claim 11, further comprising a USB connector to connect the USB interface to a motherboard.

* * * * *